US005474196A

United States Patent [19]

Fausel et al.

[11] Patent Number: 5,474,196

[45] Date of Patent: Dec. 12, 1995

[54] READY-TO-ASSEMBLE HAMPER

[75] Inventors: Stephen A. Fausel, P.O. Box 101, Wapiti, Wyo. 82450; Paul S. Ziglar, Burlington, Iowa

[73] Assignee: Stephen A. Fausel, Burlington, Iowa

[21] Appl. No.: 240,842

[22] Filed: May 11, 1994

[51] Int. Cl.[6] ..... B65D 7/00

[52] U.S. Cl. ..... 220/4.28; 220/4.33; 312/211

[58] Field of Search ..... 220/4.28, 4.33, 220/4.01, 617, 618, 622; 312/211, 257.1, 258

[56] References Cited

U.S. PATENT DOCUMENTS

| | | | |
|---|---|---|---|
| 2,607,653 | 8/1952 | Fuerst | 312/211 |
| 2,625,973 | 1/1953 | Weldon et al. | 312/211 X |
| 3,266,656 | 8/1966 | Kridle | 220/4.28 |
| 3,853,367 | 12/1974 | Jamison et al. | 312/257.1 X |
| 3,907,050 | 9/1975 | Mullings | 220/4.28 X |
| 3,966,285 | 6/1976 | Porch et al. | 220/4.28 X |
| 4,102,557 | 7/1978 | Lee et al. | 312/257.1 |
| 4,673,087 | 6/1987 | Webb | 220/4.33 X |
| 5,123,541 | 6/1992 | Giannini et al. | 220/4.33 X |

OTHER PUBLICATIONS

Undated drawing of Malba Hamper from Zenith Products Corporation (one page).

*Primary Examiner*—Steven M. Pollard

*Attorney, Agent, or Firm*—Marshall, O'Toole, Gerstein, Murray & Borun

[57] ABSTRACT

This disclosure relates to a ready-to-assemble hamper which includes a bottom frame, a top frame, and a body panel which joins together the top and the bottom frames. Disposed on the bottom frame and on the top frame are panel recesses for accepting the body panel. Each of the panel recesses is formed by an inner wall and an intermediate wall. The top and bottom frames each are affixed to the body panel by pins which are inserted successively though its inner wall, the body panel, and its intermediate wall and which are not readily visible on the assembled hamper as they are covered by outer walls on the top frame and on the bottom frame.

19 Claims, 7 Drawing Sheets

READY-TO-ASSEMBLE HAMPER

FIELD AND BACKGROUND OF THE INVENTION

This invention relates to ready-to-assemble (RTA) furniture, and more particularly, to an RTA clothes hamper.

A clothes hamper of the character described herein generally includes a top, a bottom, and a body assembled to form a relatively large container large enough to hold clothes for one or more washing machine loads of laundry. Due to their relatively large size, prior clothes hampers which are preassembled by a manufacturer are bulky to ship, occupy a great amount of retail store shelf space, and are difficult for the consumer to transport. These factors are particularly important when a "value priced" article is involved.

Some prior RTA clothes hampers (i.e. hampers which are not preassembled by the manufacturer) require the consumer to have tools available for assembly of the hamper. However, the consumer does not always have the necessary tools (or assembly skills) available.

A prior art RTA hamper is known which includes pins for affixing the body of the hamper to the top and the bottom of the hamper. Some prior RTA hampers have recesses (formed by walls) in the top and in the bottom of the hamper for accepting the body of the hamper.

It is therefore a general object of the present invention to provide a ready-to-assemble, aesthetically appealing hamper which, while on display in a store, does not occupy much shelf space and is relatively compact and easy to transport, which does not require tools for assembly, which includes pins that are not visible on the exterior of the hamper and tightly hold the top and the bottom of the hamper to the body of the hamper, and which is easily assembled.

SUMMARY OF THE INVENTION

A ready-to-assemble hamper constructed in accordance with the present invention comprises a bottom frame, a top frame, and a body panel which joins together the top and the bottom frames. Disposed on the bottom frame and on the top frame are panel recesses for accepting the bottom and top edges of the body panel. Each of those panel recesses is formed by an inner wall and an intermediate wall.

At least one of the top and bottom frames is affixed to the body panel by pins which are inserted successively though the inner wall, the body panel, and the intermediate wall and which are not readily visible from the exterior of the assembled hamper.

BRIEF DESCRIPTION OF THE DRAWING

This invention will be better understood from the following detailed description taken in conjunction with the accompanying figures of the drawing, wherein.

DETAILED DESCRIPTION OF THE INVENTION

Figure 1:
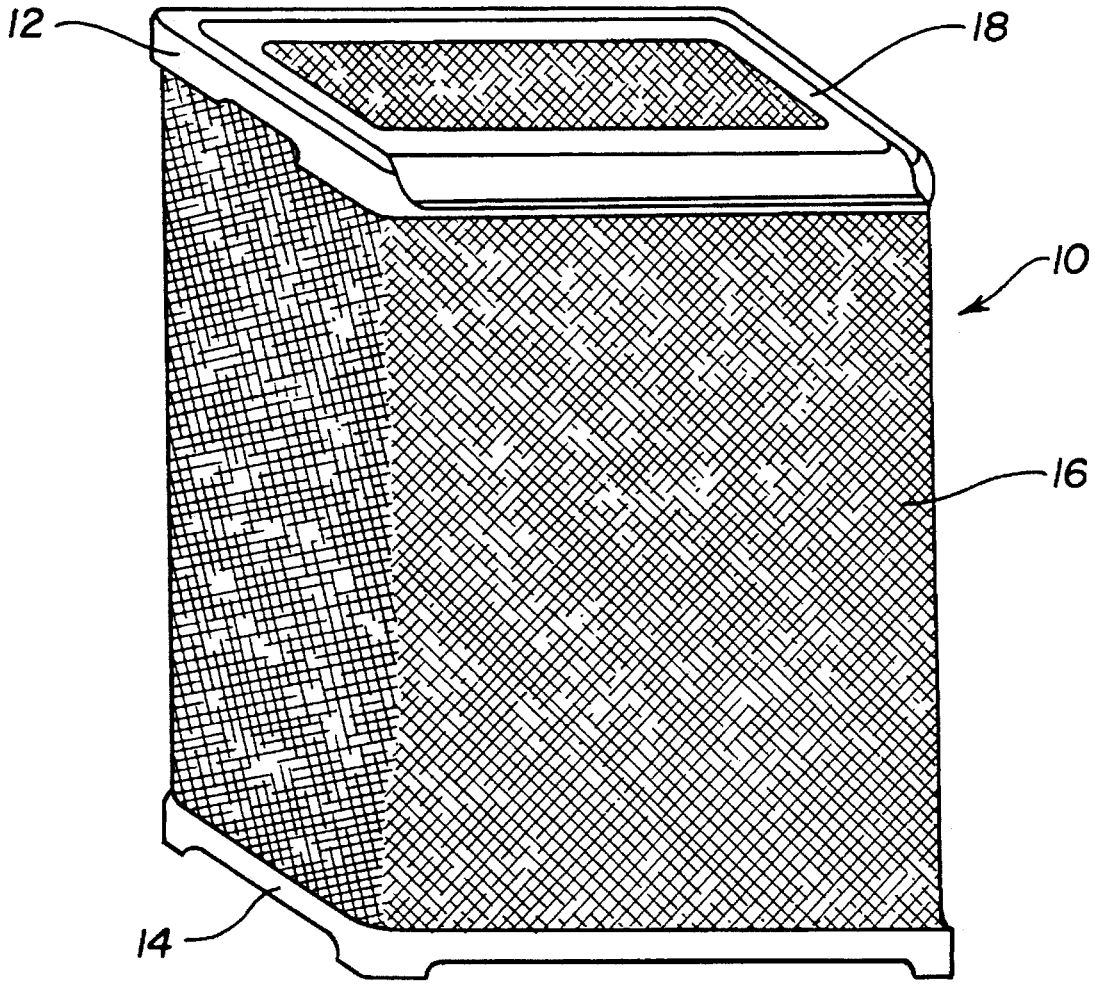
FIG. 1 is a perspective view of a ready-to-assemble hamper constructed in accordance with the present invention.

FIG. 1 shows the ready-to-assemble (RTA) hamper 10 after it has been assembled. The hamper 10 is useful for holding, for example, dirty clothes to be washed in one or more washing machine loads of laundry.

Figure 2:
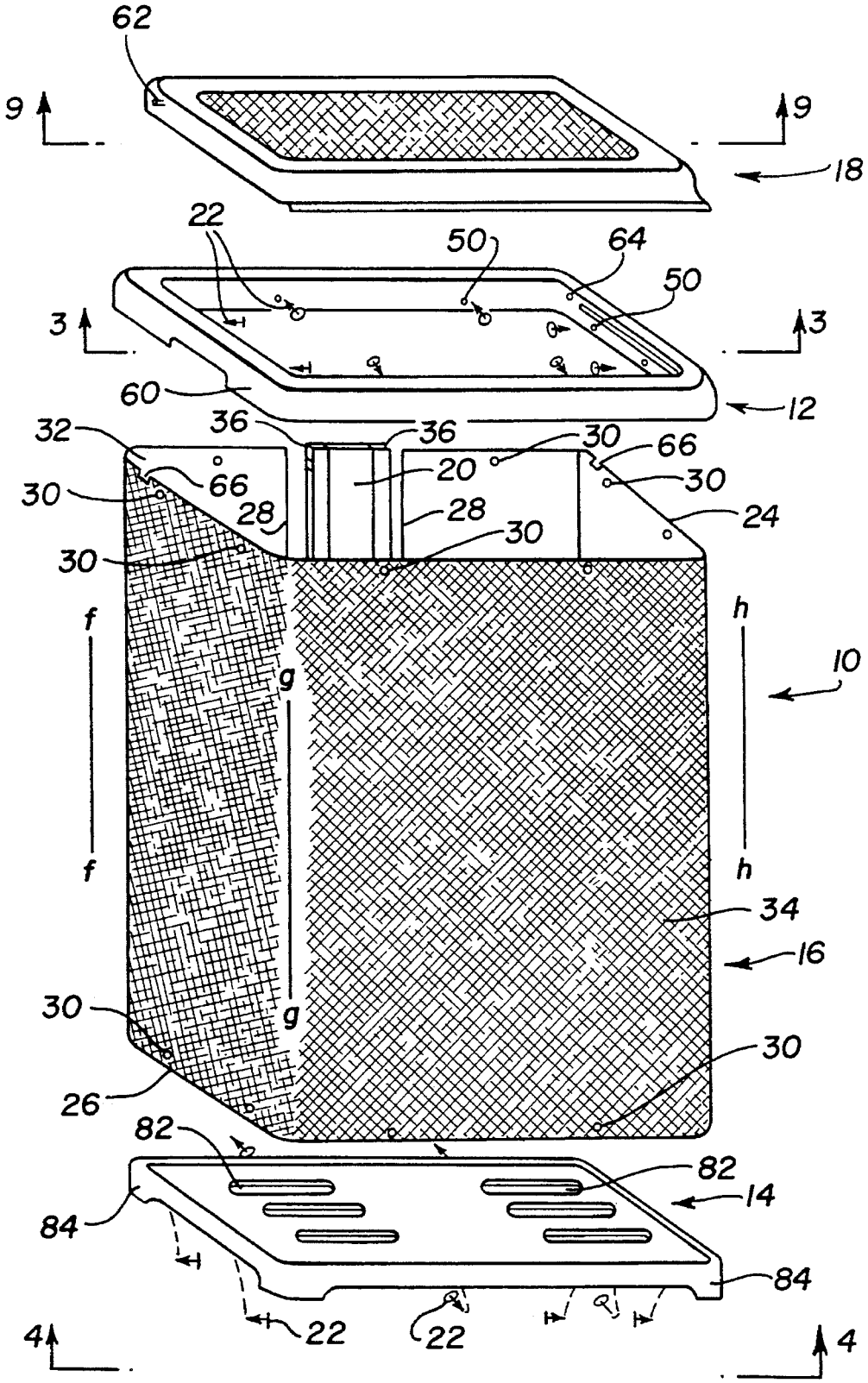
FIG. 2 is an exploded perspective view of the hamper of FIG. 1, in the form of a kit prior to assembly.

FIG. 2 is a perspective view of the hamper 10 prior to its assembly (e.g., in kit form). When sold as a kit, the components forming the hamper 10 can be compactly boxed for inventory storage and for shipment from the manufacturer to the retail store. At the retail store, at least three of the hamper 10 kits can be displayed in the shelf space otherwise occupied by one assembled hamper. Additionally, when packaged as a RTA kit, the hamper 10 can be readily transported by the purchaser of the kit.

With reference to FIGS. 1 and 2, the hamper 10 comprises a top frame 12, a bottom frame 14, a body panel 16, a lid 18, a back seam extrusion 20 and pins 22. The top frame 12, the bottom frame 14, and the lid 18, are preferably manufactured by an injection molding process. The pins 22 are preferably formed of plastic.

The body panel 16 includes a top edge 24, a bottom edge 26, two vertical side edges 28, and holes 30 disposed through the body panel 16 adjacent the top and bottom edges.

The body panel 16 preferably has a two-layer construction and comprises of a support layer 32 and a decorative outer layer 34. The support layer 32 may be formed from chipboard or other stiff, supportive material. Because the shape and the structural integrity of the hamper 10 depend substantially from the body panel, it is important to construct the support layer 32 from a suitably strong material. The decorative layer 34 may be formed, for example, from inter-woven strips of tissue-like paper (which may be coated to add strength and to make the decorative layer easier to clean) or from any of a variety of types of cloth or fabric.

Also illustrated in FIG. 2 is the back seam extrusion 20 which includes two back seam extrusion recesses 36 along its long edges. The recesses 36 extend along the vertical side edges of the extrusion 20 and are sized and configured to accept and cover the vertical side edges 28 of the body panel 16.

Figure 3:
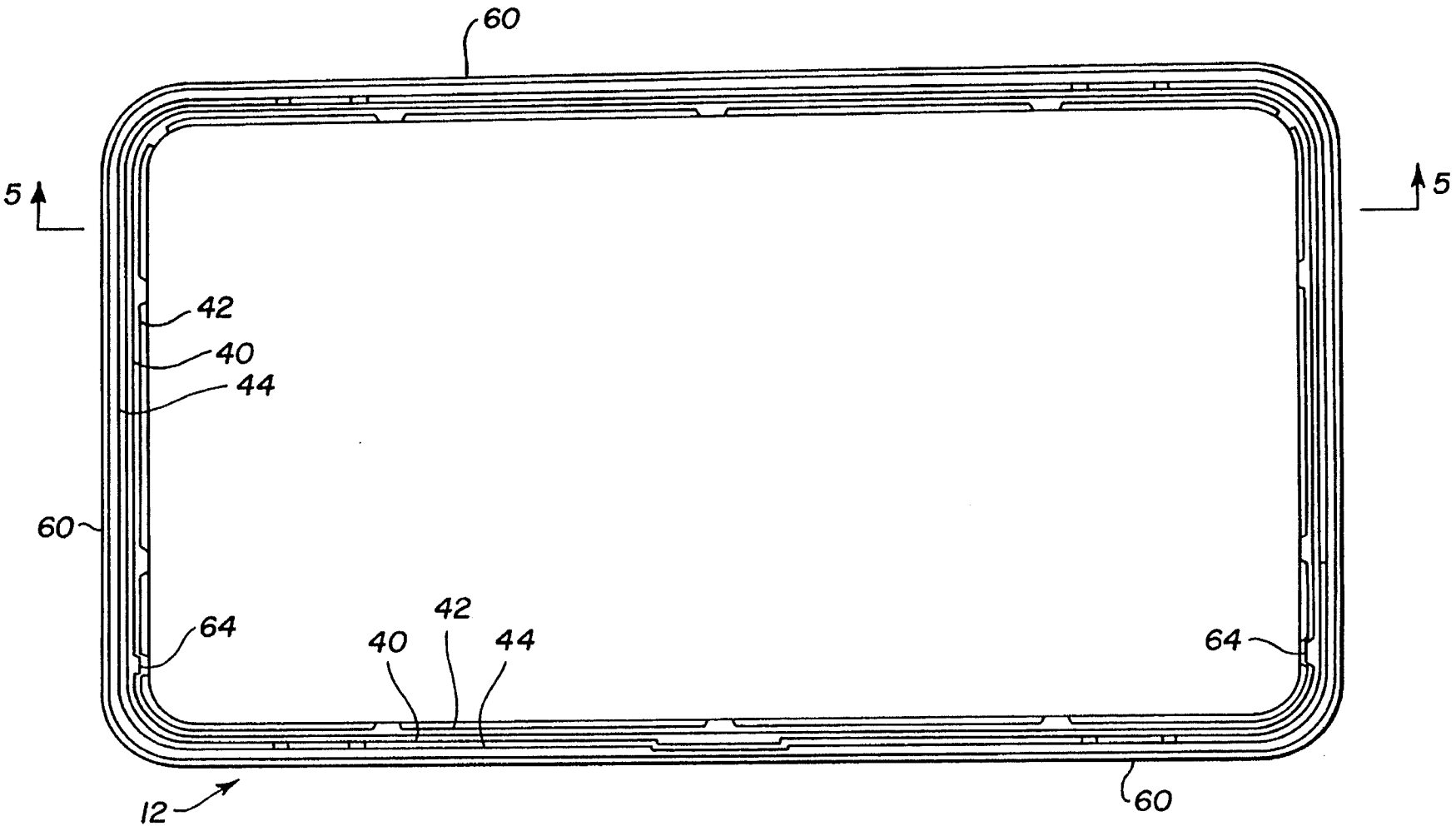
FIG. 3 is an elevational view of a top frame taken along line 3—3 of FIG. 2.
Figure 5:
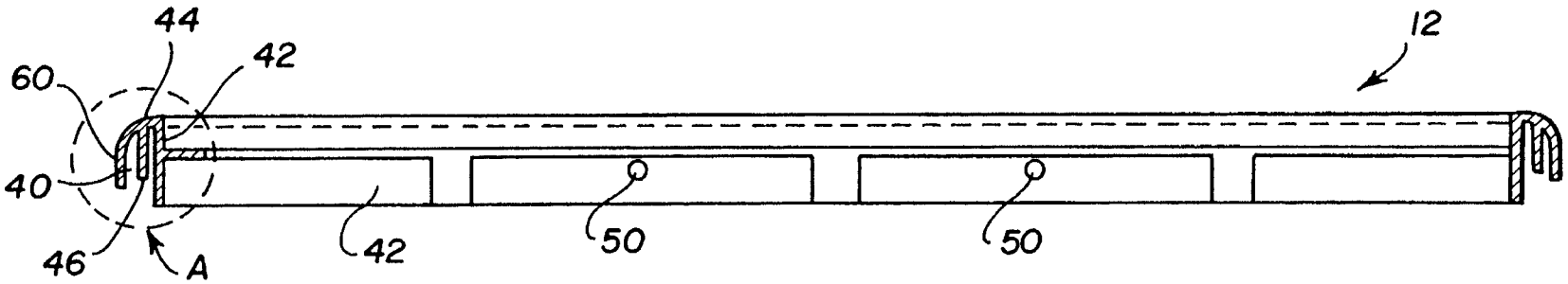
FIG. 5 is a cross-sectional view of the top frame of FIG. 3 taken along line 5—5 of FIG. 3.
Figure 6:
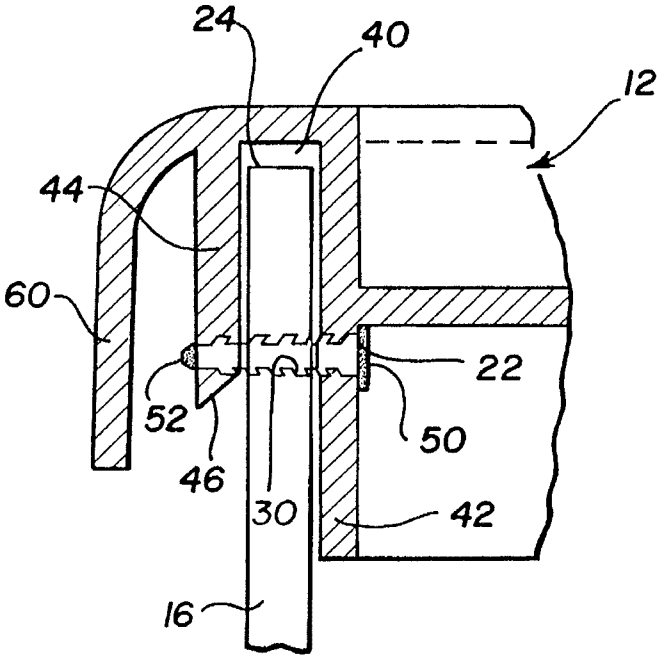
FIG. 6 is an enlarged sectional view of the structure contained in the circle A of FIG. 5, additionally illustrating a cross-sectional portion of a body panel and a pin.

As illustrated in FIGS. 3, 5, and 6, the top frame 12 is formed by a substantially continuous strip having a generally rectangular configuration, the top frame 12 being open at the center. The strip includes a panel recess 40 formed between an inner wall 42 and an intermediate wall 44. The inner wall 42 and the intermediate wall 44 are adjacent walls, each having a generally rectangular (four-sided) configuration (see FIG. 3). The panel recess 40 of the top frame 12 is sized and configured to accept the top edge 24 of the body panel 16.

As shown in FIGS. 5 and 6, the intermediate wall 44 of the top frame 12 has a top edge 46 which is generally inclined toward the inner wall 42 of the top frame 12, and the inner wall 42 of the top frame 12 is taller than the intermediate wall 44 of top frame 12. Both the angle of the top edge 46 of the intermediate wall 44 and the height of the inner wall 42 of the top frame 12 relative to the height of the intermediate wall 44 of the top frame 12 allow for the top edge 24 of the body panel 16 to be readily and easily inserted into the panel recess 40 of the top frame 12. Specifically, when so inserting the top edge 24 of the body panel 16 into the panel recess 40 of the top frame 12, the top edge 24 is first guided into the panel recess 40 by abutting the top edge 24 against the inner wall 42 of the top frame 12 and by sliding the top edge 24 toward and into the panel recess 40. Then, as the body panel 16 reaches and abuts the angled top edge 46 of the intermediate wall 44 of the top frame 12, the angled top edge 46 further guides the body panel 16 into the panel recess 40.

As illustrated in FIGS. 2, 5, and 6, disposed on the inner wall 42 of top frame 12 are holes 50. In the specific example of the invention described herein, two holes 50 are disposed on each of the four sides of the inner wall 42. Each hole 50 is disposed such that it is aligned with one of the holes 30 of the body panel 16 (FIG. 2) when the parts are assembled.

As illustrated in FIG. 6, disposed on the intermediate wall 44 of top frame 12 are holes 52. Two holes 52 are disposed on each of the four sides of the intermediate wall 44. Each hole 52 is disposed such that it is aligned with one of the holes 50 and with one of the holes 30 of the body panel 16. When the holes 50, the holes 30, and the holes 52 are so aligned, the pins 22 may be inserted successively through the holes 50, the holes 30 and the holes 52 from the interior of the top frame 12.

Figure 10:
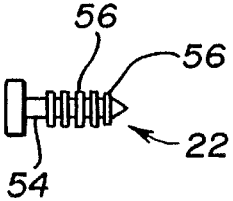
FIG. 10 is an elevational view of a pin.

The holes 50, 52 and 30 are sized and configured to accept and to securely hold the pins 22. As illustrated in FIG. 10, each of the pins 22 is made of a relatively stiff plastic and includes a pin shaft 54 and angular flanges or fins 56. Such pins are commercially available. The flanges 56 are sized and configured to hold the pins 22 tightly in the holes 50, 52, and 30. The diameter of the holes 50, 52, and 30 is slightly less than the diameter of the flanges 56, and consequently when the pins 22 are so inserted, the flanges 56 bend away from the direction of insertion and thereby securely and reliably join together the top frame 12 and the body panel 16. However, the pins 22 can be removed and the hamper 10 knocked-down (i.e., disassembled) for transport or storage.

FIGS. 2, 3, 5, and 6 also illustrate an outer wall 60 of the top frame 12. The pin shafts 54 of the pins 22 are dimensioned (in their length) such that when the pins 22 are inserted successively through the holes 50, the holes 30, and the holes 52, the pins 22 stop short of the outer wall 60 (see FIG. 6). Thus, the hamper 10 is aesthetically appealing because the pins 22 are hidden from view from the exterior of the top frame 12, by the wall 60.

Figure 9:
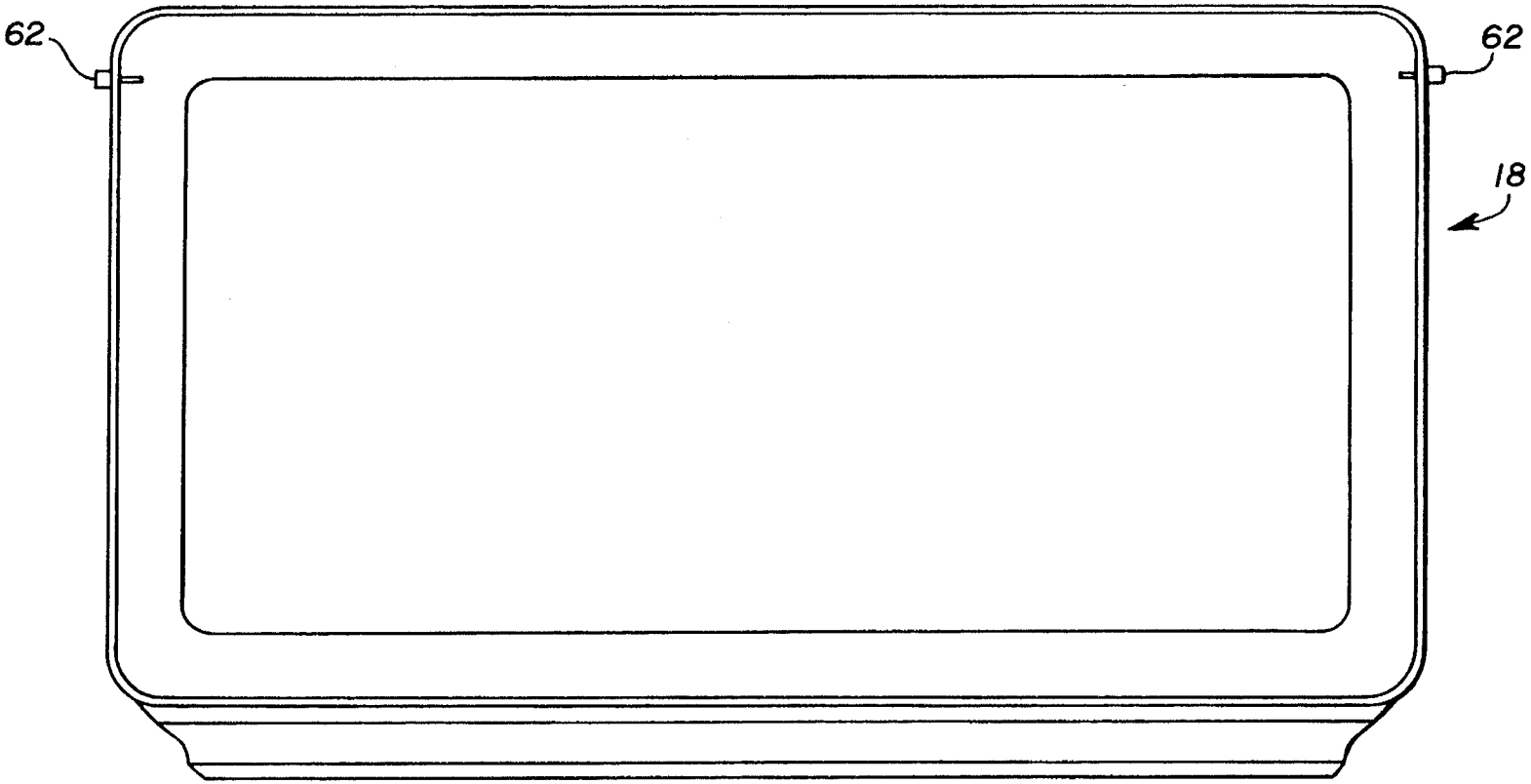
FIG. 9 is an elevational view of a lid taken along line 9—9 of FIG. 2.

FIGS. 2 and 9 illustrate the lid 18 of the hamper 10 which is sized to cover the center opening in the top frame 12. The lid has a generally rectangular shape, and disposed on the lid 18 are two lid pins 62 for hingedly connecting the lid 18 to the top frame 12. Shown in FIGS. 2 and 3 are two lid pin holes 64 disposed in the inner wall 42 of the top frame 12 for hingedly connecting to and accepting the lid pins 62 of the lid 18. The body panel 16 includes two notches 66 (see FIG. 2) which are aligned with the lid pins holes 64 and which are sized to allow the lid pins 62 to pass therethrough. The plastic lid has sufficient flexibility that it may be flexed or bowed slightly to enable the pins 62 to be inserted into the holes 64.

Figure 4:
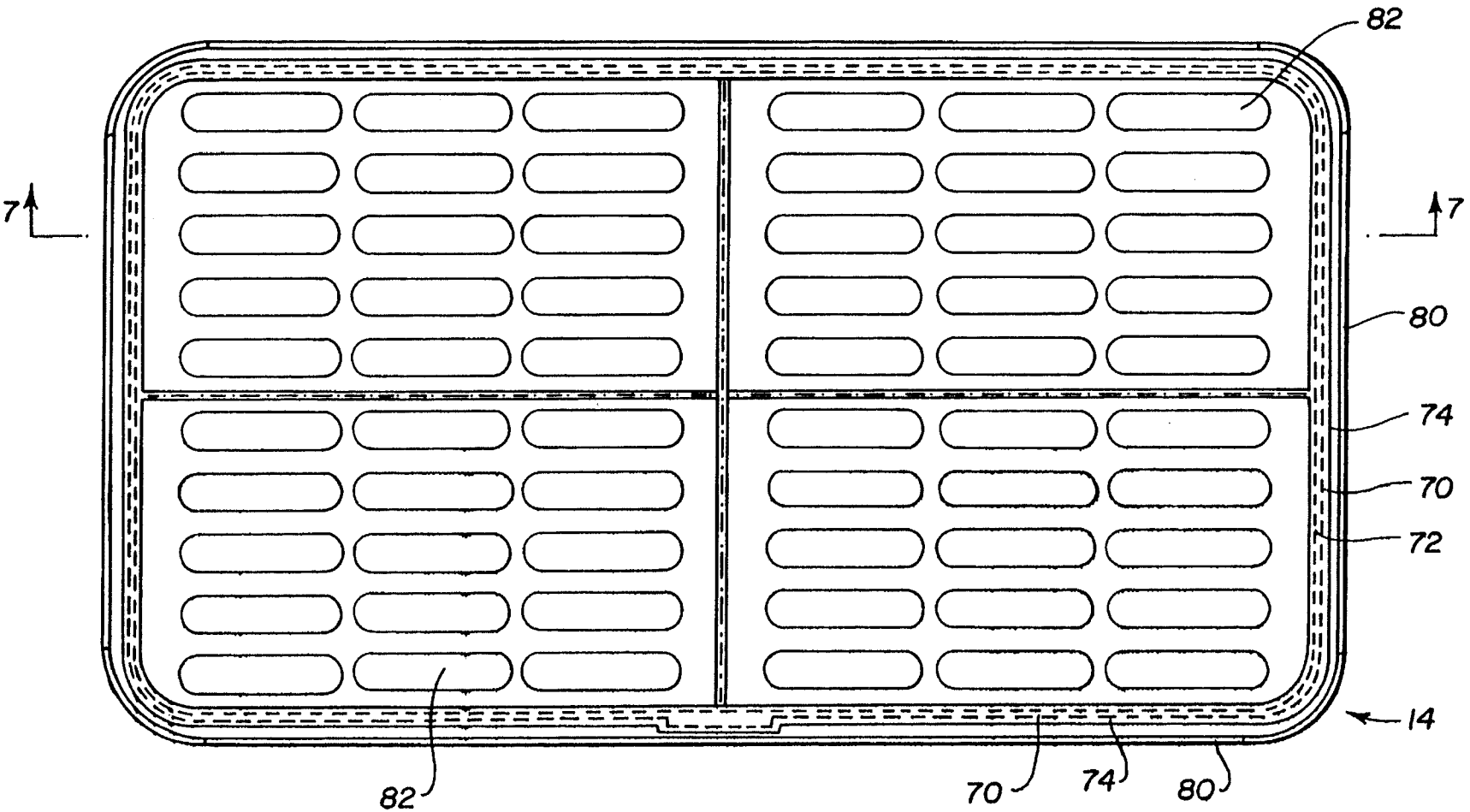
FIG. 4 is an elevational view of a bottom frame taken along line 4—4 of FIG. 2.
Figure 7:
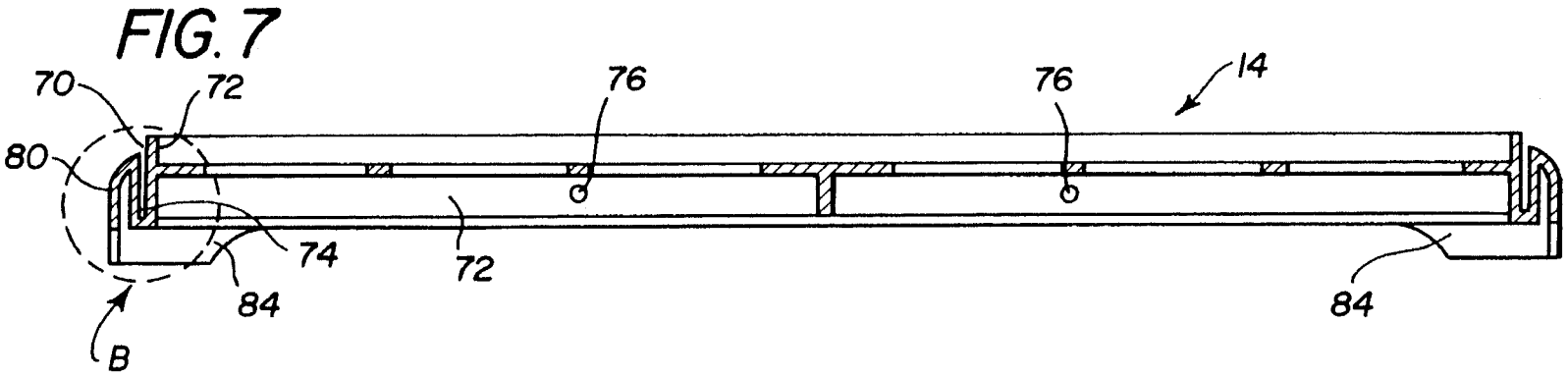
FIG. 7 is a cross-sectional view of the bottom frame of FIG. 4 taken along line 7—7 of FIG. 4.
Figure 8:
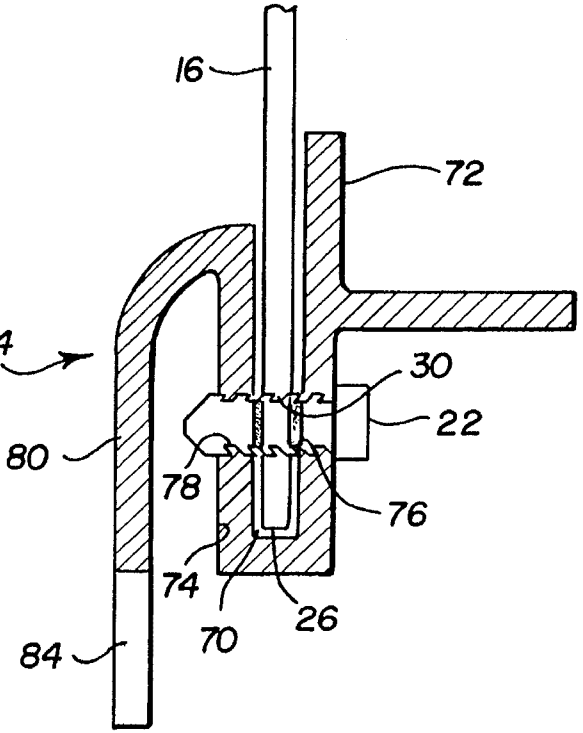
FIG. 8 is an enlarged sectional view of the structure contained in the circle B of FIG. 7, additionally illustrating a cross-sectional portion of a body panel and a pin.

As illustrated in FIGS. 4, 7, and 8, the bottom frame 14 includes a panel recess 70 formed between an inner wall 72 and an intermediate wall 74. The inner wall 72 and the intermediate wall 74 are adjacent walls, each having a generally rectangular (four-sided) configuration (see FIG. 4). The panel recess 70 of the bottom frame 14 is sized and configured to accept the bottom edge 26 of the body panel 16.

As shown in FIGS. 7 and 8, the inner wall 72 of the bottom frame 14 is taller than the intermediate wall 74 of bottom frame 14. The height of the inner wall 72 relative to the height of the intermediate wall 74 allows for the bottom edge 26 of the body panel 16 to be readily and easily inserted into the panel recess 70 of the bottom frame 14. Specifically, when so inserting the bottom edge 26 of the body panel 16 into the panel recess 70, the bottom edge 26 is guided into the panel recess 70 by abutting the bottom edge 26 against the inner wall 72 of the bottom frame 14 and by sliding the bottom edge 26 against the inner wall 72 and into the panel recess 70.

As illustrated in FIGS. 7 and 8, disposed on the inner wall 72 of bottom frame 14 are holes 76. Two holes 76 are disposed on each of the four sides of the inner wall 72. Each hole 76 of the inner wall 72 of the bottom frame 14 is disposed such that it is aligned with one of the holes 30 of the body panel 16 (FIG. 2) when the parts are assembled.

As illustrated in FIG. 8 disposed on the intermediate wall 74 of bottom frame 14 are holes 78. Two holes 78 are disposed on each of the four sides of the intermediate wall 74. Each hole 78 of the intermediate wall 74 of the bottom frame 14 is disposed such that it is aligned with one of the holes 76 of the inner wall 72 of the bottom frame 14 and with one of the holes 30 of the body panel 16. When the holes 76, the holes 30, and the holes 78 are so aligned, the pins 22 may be inserted successively through the holes 76, the holes 30, and the holes 78 from the interior of the bottom frame 14.

The holes 76 of the inner wall 72 of the bottom frame 14, the holes 78 of the intermediate wall 74, and the holes 30 of the body panel 16 are sized and configured to accept and to securely hold the pins 22, similarly to the attachment of the pins at the top frame 12.

FIGS. 4, 7, and 8 also illustrate an outer wall 80 of the bottom frame 14. The pin shaft 54 of the pins 22 is dimensioned (in its length) such that when the pins 22 are inserted successively through the holes 76, the holes 30, and the holes 78, the pins 22 will not project through the outer wall 80 of the bottom frame 14. Thus, the hamper 10 is aesthetically pleasing because the pins 22 are not visible on either the exterior of the bottom frame 14 or on the exterior of the top frame 12.

Also illustrated in FIGS. 2 and 4 are a plurality of openings 82 which form air vents in the bottom frame 14. Shown in FIGS. 2, 7, and 8 are feet 84 of the bottom frame 14, which elevate the hamper 10 above a support surface (e.g., the floor) and allow air to circulate under the hamper and through the openings 82.

As can be understood from the above description of the invention and as set forth hereinafter, the hamper 10 can be assembled without the use of tools.

As illustrated in FIG. 2, the body panel 16 of the hamper 10 is folded along four lines f—f, g—g, h—h, and i—i to form a rectangular shape and the panel 16 is preferably precreased at the four corners to facilitate the folding. Once folded, the top edge 24 of the body panel 16 has the same approximate configuration as the panel recess 40 of the top frame 12 and the bottom edge 26 of the body panel 16 has the same approximate configuration as the panel recesses 70 of the bottom frame 14. The top edge 24 of the body panel 16 is then inserted into the panel recess 40 of the top frame 12.

The back seam extrusion 20 of the hamper 10 is then positioned with the two vertical side edges 28 of the body panel 16 in the recesses 36. Thus, the back seam extrusion 20 of the hamper 10 covers the vertical side edges 28 of the body panel 16.

In an alternative embodiment of the present invention, prior to assembly of the hamper 10, one of the back seam extrusion recesses 36 of the back seam extrusion 20 is secured(e.g., glued by the manufacturer) to one of the vertical side edges 28 of the body panel 16. In this embodiment, beginning at the vertical side edge 28 which has been fixed to the back seam extrusion 20, the top edge 24 of the body panel 16 is walked-around (i.e., inserted into) the panel recess 40 of the top frame 12. Then, the other vertical side edge 28 of the body panel 16 is inserted into the other back seam extrusion recess 36 of the back seam extrusion 20.

After the back seam extrusion 20 is joined to the body panel 16, the bottom edge 26 of the body panel 16 is inserted into the panel recess 70 of the bottom frame 14. Then, the pins 22 are pushed successively through the holes 50 of the inner wall 42 of the top frame 12, the holes 30 of the body panel 16, and the holes 52 of the intermediate wall 44 of the top frame 12. Others of the pins 22 are pushed successively through the holes 76 of the inner wall 72 of the bottom frame 14, the holes 30 of the body panel 16, and the holes 78 of the intermediate wall 74 of the bottom frame 14.

The last assembly step includes positioning the lid 18 so that one of the lid pins 62 of the lid 18 can be inserted through one of the lid pin holes 64 of the top frame 12 and through one of the notches 66 of the body panel 16, and then flexing the lid so that the other one of the lid pins 62 can be inserted through the other one of the lid pin holes 64 and through the other one of the notches 66. Thus positioned, the lid 18 hingedly connected to and will cover the center opening of the top frame 12.

Obviously, modifications and variations of the present invention are possible in light of the above teachings. Thus, it is to be understood that, within the scope of the appended claims, the invention may be practiced other than is specifically set forth above.

What is claimed is:

1. A ready-to-assemble hamper kit capable of being assembled with or without tools, said kit comprising:

a) a top frame;

b) a bottom frame;

c) a body panel adapted to join together said top frame and said bottom frame;

d) each of said top and bottom frames including a panel recess adapted to accept said body panel, each of said panel recesses being formed by an inner wall and an intermediate wall;

e) said body panel having at least one hole disposed therethrough, at least one of said top and bottom frames including at least one hole disposed through said inner wall and said intermediate wall forming said panel recess;

f) at least one pin adapted to be inserted successively through said hole in said inner wall of said panel recess, said hole in said body panel, and said hole in said intermediate wall of said panel recess; and g) said one of said top and bottom frames including means for covering said pin from view externally of said one frame.

2. The ready-to-assemble hamper kit as set forth in claim 1, wherein said body panel has at least one additional hole disposed therethrough, each of said inner walls and each of said intermediate walls of both of said top and bottom frames including at least one hole disposed therethrough.

3. The ready-to-assemble hamper kit as set forth in claim 2, wherein said means for covering comprises an outer wall adapted to cover said pins in said top and bottom frames.

4. The ready-to-assemble hamper kit as set forth in claim 1, wherein said top frame includes a center opening, and further comprising a lid adapted to cover said center opening of said top frame.

5. The ready-to-assemble hamper kit as set forth in claim 4, further comprising hinge means for connecting said lid to said top frame.

6. The ready-to-assemble hamper kit as set forth in claim 1, wherein said body panel includes two vertical side edges.

7. The ready-to-assemble hamper kit as set forth in claim 6, further comprising a back seam extrusion for connecting and covering said vertical edges of said body panel.

8. The ready-to-assemble hamper kit as set forth in claim 7, wherein said back seam extrusion is adapted to be affixed to one of said vertical edges.

9. The ready-to-assemble hamper kit as set forth in claim 1, wherein said bottom frame includes feet for elevating said hamper above a support surface.

10. The ready-to-assemble hamper kit as set forth in claim 9, wherein said bottom frame also includes openings for allowing air to circulate into said hamper.

11. The ready-to-assemble hamper kit as set forth in claim 1, wherein said body panel includes a support layer and a decorative layer.

12. The ready-to-assemble hamper kit as set forth in claim 1, wherein said holes include edges, and said pins include flanges adapted to engage said edges of said holes.

13. The ready-to-assemble hamper kit as set forth in claim 1, wherein said inner wall of said panel recess of said top frame is taller than said intermediate wall of said panel recess of said top frame and said inner wall of said panel recess of said bottom frame is taller than said intermediate wall of said panel recess of said bottom frame.

14. The ready-to-assemble hamper kit as set forth in claim 1, wherein said intermediate wall of said panel recess of said top frame includes a top edge, said top edge being angled to incline toward said inner wall of said panel recess of said top frame.

15. A hamper, comprising:

a) a top frame;

b) a bottom frame spaced from said top frame;

c) a body panel having end portions, said body panel extending between and said end portions engaging said top frame and said bottom frame;

d) each of said top and bottom frames comprising a panel recess formed by an inner wall and an intermediate wall, said panel recesses receiving said end portions of said body panel;

e) said end portions of said body panel having at least two holes disposed therethrough, said inner walls and said intermediate walls of said top and bottom frames including holes therein aligned with said holes of said body panel; and f) a pin inserted through each of said aligned holes in said panel and said top and bottom frames;

g) each of said top and bottom frames further including means for covering said pins from view on the exterior of said hamper.

16. The hamper as set forth in claim 15, further comprising a back seam extrusion for joining together said body panel.

17. The hamper as set forth in claim 15, wherein said top frame includes a center opening, further comprising a lid shaped to cover said opening of said top frame.

18. The hamper as set forth in claim 15, wherein said bottom frame includes feet for elevating said hamper above a support surface.

19. The hamper as set forth in claim 18, wherein said bottom frame also includes openings for allowing air to circulate into the hamper.

* * * * *